US007765056B2

(12) United States Patent
Cattin et al.

(10) Patent No.: US 7,765,056 B2
(45) Date of Patent: Jul. 27, 2010

(54) MAGNETIC TRAFFIC CONTROL SYSTEM

(75) Inventors: Viviane Cattin, St Egreve (FR); Roland Blanpain, Entre-Deux-Guiers (FR); Bruno Flament, St Julien de Ratz (FR); Bernard Guilhamat, St Michel de St Geoirs (FR)

(73) Assignee: Commissariat a l'Energie Atomique, Paris (FR)

( * ) Notice: Subject to any disclaimer, the term of this patent is extended or adjusted under 35 U.S.C. 154(b) by 728 days.

(21) Appl. No.: 11/619,791

(22) Filed: Jan. 4, 2007

(65) Prior Publication Data

US 2007/0162218 A1 Jul. 12, 2007

(30) Foreign Application Priority Data

Jan. 11, 2006 (FR) ..... 06 50097

(51) Int. Cl.
*G08G 1/00* (2006.01)

(52) U.S. Cl. ..... 701/117; 340/933; 340/937; 340/941; 340/942; 702/65

(58) Field of Classification Search ..... 701/117, 701/118, 119; 340/905, 933, 934
See application file for complete search history.

(56) References Cited

U.S. PATENT DOCUMENTS 3,781,664 A * 12/1973 Rorden ..... 324/247
4,509,131 A 4/1985 Krasnjanski
5,331,276 A 7/1994 Polvani et al.
5,392,034 A * 2/1995 Kuwagaki ..... 340/933
5,491,475 A * 2/1996 Rouse et al. ..... 340/933
5,614,894 A 3/1997 Stanczyk (Continued)

FOREIGN PATENT DOCUMENTS

EP 0 770 978 A1 5/1997

(Continued)

OTHER PUBLICATIONS

C.S. Myers, et al., "A Comparative Study of Several Dynamic Time-Warping Algorithms for Connected-Word Recognition", The Bell System Technical Journal, vol. 60, No. 7, Sep. 1981, pp. 1389-1409.

*Primary Examiner*—Khoi Tran
*Assistant Examiner*—Rodney King
(74) *Attorney, Agent, or Firm*—Oblon, Spivak, McClelland, Maier & Neustadt, L.L.P.

(57) ABSTRACT

A system for measuring a magnetic signature of a vehicle, including: at least a first set of sensors ($C^x_i$) that are stationary and arranged along at least a first direction; at least a second set of sensors ($C^y_j$) that are stationary and arranged along at least a second direction that intersects the first direction; a common sensor ($C^{xy}_0$) arranged at a location where the first set of sensors and the second set of sensors intersect, said common sensor belonging to the first and the second sets of sensors, wherein the first set of sensors and the second set of sensors are arranged so that the vehicle passes above at least part of the sensors of the first and second set of sensors; and a calculation device for calculating a relation between a time signature $S_o(t)$ of the vehicle passing above the common sensor and a spatial profile $S_o(x)$ resulting from measurements made by the first set of sensors.

20 Claims, 6 Drawing Sheets

U.S. PATENT DOCUMENTS

| | | | | |
|---|---|---|---|---|
| 6,607,212 | B1 * | 8/2003 | Reimer et al. | 280/735 |
| 6,614,536 | B1 | 9/2003 | Doemens et al. | |
| 6,865,518 | B2 | 3/2005 | Bertrand et al. | |
| 7,180,418 | B1 * | 2/2007 | Willms et al. | 340/568.1 |
| 7,668,692 | B2 * | 2/2010 | Tatom et al. | 702/173 |
| 2002/0063778 | A1 * | 5/2002 | Kormos | 348/148 |
| 2002/0154032 | A1 * | 10/2002 | Hilliard et al. | 340/933 |
| 2003/0141762 | A1 * | 7/2003 | Sartori et al. | 307/10.1 |
| 2003/0163263 | A1 * | 8/2003 | Bertrand et al. | 702/65 |
| 2004/0113818 | A1 * | 6/2004 | Yokokohji et al. | 340/995.1 |
| 2006/0142920 | A1 * | 6/2006 | Hashiba | 701/70 |
| 2007/0055426 | A1 * | 3/2007 | Hara et al. | 701/41 |

FOREIGN PATENT DOCUMENTS

| | | |
|---|---|---|
| EP | 0 841 647 A1 | 5/1998 |
| FR | 2 693 301 | 1/1994 |
| FR | 2 811 789 | 1/2002 |

* cited by examiner

MAGNETIC TRAFFIC CONTROL SYSTEM

TECHNICAL FIELD AND PRIOR ART

The invention relates to a method and device for classification of vehicles starting from their electromagnetic signature.

It is capable of collecting road data and for example counting and/or classifying automobile vehicles as they pass along a road.

Therefore, the invention relates to the field of study and control of road traffic, for which there are very many applications. For example:

identification and classification by vehicle type: one characteristic example is classification at a motorway tollbooth for automatic payment. The system used on motorways nowadays is based on a combination of several types of sensors:

a magnetic switch composed of two current loops, that detects the presence of a vehicle, a piezoelectric type sensor placed on the road surface, to detect passage of the axles of a vehicle to count them, an optical sensor that forms a curtain placed transverse to the road: when the vehicle crosses the sensor, it gives an estimate of its height.

The main disadvantages of this device are its cost, lack of robustness (particularly with regard to weather conditions), difficult maintenance (particularly due to wear of current loops) and a mediocre classification error rate.

The invention is also used for identifying private vehicles, for example for road traffic regulation, monitoring of traffic on a road, traffic optimisation, monitoring a vehicle in a restricted road area. (pedestrian area) or in a car park, assignment of a particular service to an identified vehicle (private parking space, subscription to a gasoline station, etc.).

Another application of the invention is authentication of private cars: for example, it could be a vehicle provided with a remote identification system (for example RFID badge) that is validated by reading and authenticating the magnetic signature of the vehicle (this signature being obtained by a device or a method according to the invention).

There are systems based on magnetoresistances or current loop networks. But they are either expensive or they have poor performances in terms of vehicle recognition.

Magnetic traffic control systems are based on interpretation of the magnetic signature of a vehicle. An automobile is a magnetic mass that modifies field lines because the magnetic field tends to follow the path with the highest magnetic permeability. Furthermore, an automobile may contain ferrous materials that modify the direction and intensity of the magnetic field. The vehicle is globally represented by a set of magnetic dipoles that are additional to the earth's quiescent magnetic field (in other words temporarily at rest) and that create a magnetic anomaly that can be measured by magnetic sensors.

These signals are then used in a detection/classification system that may have the objective of counting or identifying vehicles. Each class may be characterised by a number of parameters, the most frequently used of which are the number of axles, inter-axle distances, the vehicle length, distances between the road and the car body and/or between axles.

One of the difficulties of classification systems is based on time/space correspondence. Signatures are acquired by magnetic sensors during time. Therefore, they depend on the vehicle speed; they may be compressed if the vehicle accelerates, stretched if it brakes, or even constant if it stops, as shown in FIG. 1 on which curves I and II represent the time deformation of the signature of a vehicle passing quickly over one sensor, and slowly and stopping over the other sensor. On the other hand, the spatial magnetic signature of the vehicle is constant.

Therefore, the objective is a method of transferring time signatures into the space domain, independently of the speed and the path of the vehicle.

Patent FR-2811789 discloses a vehicle classification system used to detect the electromagnetic signature starting from a single current loop. This signature is digitised, sequenced and then dated. The vehicle speed may also be calculated, searching for the moment at which the rate of the signature stops following an exponential law.

This calculation is not sufficiently precise and it cannot be used to check if the vehicle is stopped on the sensor. The measured characteristics are restricted to signal amplitudes in its time representation and its frequency representation.

U.S. Pat. No. 5,331,276 discloses a speed measurement system including two biaxial FluxGate magnetometers separated by a known distance and oriented precisely with respect to each other. The speed of the vehicle running close to the system is calculated by forming the ratio between the derivative of the measured field with respect to time (given by the derivative of a signal B from one of the magnetometers with respect to time) and the derivative of measured signals with respect to space (calculated by the instantaneous difference of two signals B measured on the two magnetometers). The condition necessary for the spatial difference of the fields of the two sensors to be approximately equal to the spatial gradient, is that the space between the two sensors is not too short and not too large (it must be equal to not more than 1/10 of the distance at the closest passage point of the vehicle). This constraint limits use of this device to specific trajectories and to specific vehicles, with an only slightly varying equivalent magnetic moment.

Several vehicle classification systems propose to determine the speed by making use of the difference in time between two signatures measured by sensors placed at known distances. But before the time offset of the signatures can give good estimate of its speed, the speed must be constant on the calculation base (inter-sensors distance). Under normal road traffic conditions, vehicles rarely follow a uniform movement, particularly for example close to motorway tollbooths.

Patent EP 0770978 discloses such a vehicle detection system with several sensors arranged in a floor or a ceiling, placed in tubes arranged transverse to the vehicle trajectory. The distance between two adjacent sensors in a tube is less than or approximately equal to the normal width of a tire, so as to detect vehicle twin wheels. By placing two detector tubes parallel to each other and transverse to the longitudinal direction of the road surface, and separated by a known distance, it is possible to identify the detection times of a vehicle and to calculate the time spent by the vehicle to move from one device to the next. U.S. Pat. No. 4,509,131 proposes to use a correlation to make a comparable calculation, with the device being placed on the vehicle and making use of magnetic signatures of the ground.

Patent EP 0841647A1 discloses a multipoint measurement device arranged transverse to the road. It is used to make a map of the vehicle in time and in space. A calculation to reduce the number of data is used to extract a set of characteristic values for each vehicle from the map, independently of its dimensions or the number of axles. This device is used to identify each vehicle in order to monitor road traffic. It is not a classification system. Furthermore this method, although creating a time/space relation, cannot be used to obtain an image of the object.

Therefore, there is a real problem in finding a method and a device capable of obtaining such a spatial image of the magnetic signature of the vehicle.

PRESENTATION OF THE INVENTION

According to the invention, a multisensor device is used and space and time information is used to extract the characteristics of the magnetic signatures of vehicles.

The invention relates firstly to a device for measuring the magnetic signatures of vehicles including:

- at least a first set of sensors ($C^x_i$), designed to be arranged along at least a first direction,
- at least a second set of sensors ($C^y_j$) designed to be arranged along at least a second direction, that intersects the first direction at a point at which a common sensor ($C^{xy}_0$) is placed, belonging to the first and the second set,
- calculation means to calculate a relation between the time signature $S_o(t)$ of a vehicle passing above the common sensor and a spatial profile $S_o(x)$ resulting from measurements made by the sensors in the first set of sensors.

According to the invention, first magnetic measurements along the displacement direction are used to obtain a law between the time and position of the sensors, and this law is then applied to another series of measurements made in at least one other direction. The time concept disappears and the result is a spatial image of the object, but that is not a photo of the object at time t, because in a way, time was "stretched" on the first sensors.

At least one second direction may be perpendicular to the first direction. A device according to the invention may also comprise a third set of sensors that will be arranged along at least one third direction that intersects the first at a point at which a common sensor is arranged, belonging to the first and the third set.

The calculation means may also be used to calculate the speed of the vehicle.

A device according to the invention may comprise a plurality of first sets of sensors and a plurality of second sets of sensors forming a 2D matrix of sensors, the matrix possibly being hollow.

According to one variant, the device according to the invention may include a first set of sensors, at least one second set of sensors, and at least one 2D matrix of sensors arranged on at least one of the sides of the first set.

At least one 1D, or 2D or 3D field sensor or field gradient sensor may be arranged along the vertical direction or it may be offset.

The calculation means can be used to form a spatial representation of the signature of vehicles and/or to extract vehicle identification parameters from said spatial representation, for example by thresholding said spatial representation, the length and/or the width of the vehicle, or by detection of intensity maxima, the number of vehicle axles, and/or to calculate the energy of the signature and/or at least part of its Fourier coefficients and/or the angle crossed by the magnetic field vector (also using a triaxial field sensor) and/or the derivative of the signature P(X,Y) along X and/or a map of gradients and/or a vertical gradient of the field and the ratio of this gradient to the field.

These parameters may be used in a classification algorithm.

The invention also relates to a method for recognition of the magnetic signature of a moving object including the use of device according to the invention as described above.

According to the invention, the first magnetic measurements along the displacement direction are used to obtain a law between time and the position of the sensors, and this law is then applied to another series of measurements made in at least one other direction. The time concept disappears and the result is a spatial image of the object but that is not a photo of the object at a time t because in the way, time was "stretched" on the first sensors.

DETAILED PRESENTATION OF PARTICULAR EMBODIMENTS

We will start by describing a device according to the invention and different variants and their use.

We will then describe processing of data.

A first embodiment of the invention uses a multisensor device.

Space and time information is interpreted so as to extract the characteristics of magnetic signatures of vehicles. Each sensor is an element capable of measuring one or several components of the local magnetic field or the local magnetic gradient (for example such as "FluxGate" type magnetometers).

Figure 1:
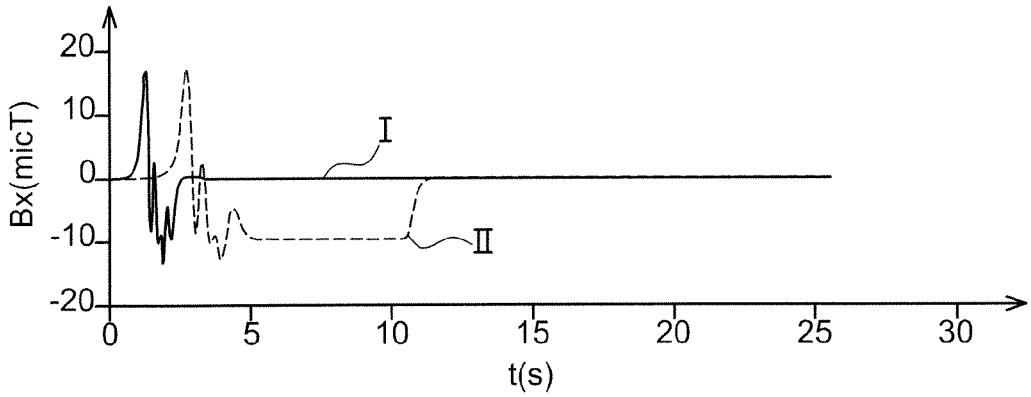
FIG. 1 shows a simulated example of the deformation in time of a signature of a vehicle passing quickly over one sensor, and slowly and stopping on another.
Figure 2:
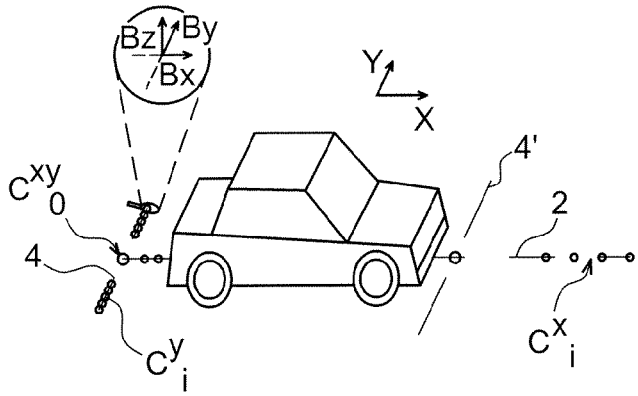
FIG. 2 shows a "T" device according to the invention, with two lines.

These sensors are distributed on at least one line 2 oriented parallel to the running direction (direction denoted X, sensors $C^X_i$) and on at least one line 4 oriented differently (direction denoted Y, sensors $C^Y_i$), these lines including at least one common sensor $C^{xy}_0$, as shown in FIG. 2.

There is then time and space information available that can be related by a so-called "morphing" technique, for example as described in the article by C. S. Myers et al. "a comparative study of several dynamic time-warping algorithms for connected-word recognition", The Bell System technical Journal, vol. 60, No 7, 1981. It is thus possible to build up a 2D spatial photo of the vehicle signature.

The arrangement described above covers a set of cases, some of which are illustrated as examples in the following sections.

According to a first example embodiment, called the basic device, sensors are arranged for example in the form of a "T" (case in FIG. 2).

In a first version, the number of sensors is reduced: a limit is set to two lines, unlike the general case wherein there may be more than two lines. There are:

$N_x$ (>1) $C^X_i$ sensors on a single line 2, $N_y$ (>1) $C^Y_i$ sensors on a single line 4.

In FIG. 2, Y is perpendicular to X, and therefore transverse to the running direction.

These two lines 2, 4 have at least one sensor $C^{XY}_0$ in common at their intersection. This intersection may be located anywhere along lines 2 and 4. For example, FIG. 2 locates the sensor $C^{XY}_0$ at the beginning of line 2 and at the centreline 4, but other arrangements are possible, for example line 4 may be located between the ends of line 2 (see position 4' in FIG. 2) with a sensor $C^{XY}{}_0$' in common between lines 2 and 4'.

The sensors may also be uniformly distributed on each line, or arranged with a variable pitch. In particular, on line 4, it is useful to concentrate the density of sensors in zones wherein vehicle wheels are statistically likely to pass, particularly as to obtain axle signatures, which are important elements for automobile classification. This is the special case shown in FIG. 2.

At each moment, measurements output from sensors $C^x{}_i$ arranged along line 2 output a spatial profile $S_o(x)$, or a section along X, of the vehicle signature.

Pre-processing, for example of the thresholding type, provides the means of detecting the beginning and end of the useful magnetic signature.

Each spatial profile is wholly or partly comparable to the time measurement $S_o(t)$ output from the sensor $C^{xy}{}_0$ when the vehicle passes above the intersection of the lines 2, 4. The main difference is due to the deformation with time of the spatial vehicle signature related to the speed of the vehicle. Minor dissimilarities may also appear locally along the magnetic signature, because $S_o(t)$ is a developed shape of the local signature (in $C^{xy}{}_0$) of the vehicle, while $S_o(x)$ is instantaneous value. Globally, the signal $S_o(t)$ may be seen as a compressed version of the signal $S_o(x)$ (if the vehicle accelerates), stretched (if it brakes), or constant (if it stops), or even turned over (if the vehicle reverses) or possibly deformed and in pieces.

A "morphing" technique can be used (for example such as the "Direct Time Warping" algorithm used in word processing, see bibliography reference given above, article by C. S. Myers et al.) to determine the L(t−x) relation between these two signals $S_o(x)$ and $S_o(t)$.

Figure 3:
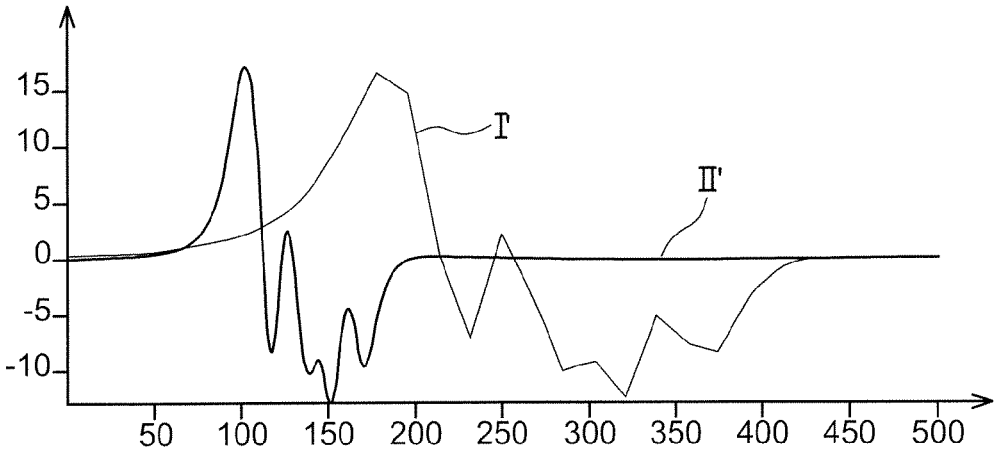
FIG. 3 shows "morphing", relating a time function $S_o(t)$ and a spatial function $S_o(x)$.

A "morphing" algorithm searches for the point to point correspondence between two shapes as shown in FIG. 3, on which the curves I' and II' respectively represent $S_o(x)$ and $S_o(t)$. The algorithm is used to find a point of the spatial signature $S_o(x)$ that was:

- more or less far from the adjacent point (acceleration or braking),
- repetition for a given time (stop),
- a movement in the opposite direction (reverse).

The "morphing" technique is very well applicable to this problem because the set of magnetic dipoles that form a vehicle follows the same kinetics.

It is a technique capable of gradually changing from one signal to another, in the most continuous possible way. For example, such a technique is described in the document by C. S. Myers mentioned above.

Furthermore, the relation L(t−x) is also characteristic of the speed profile of the vehicle as it passes above the sensor $C^{xy}{}_0$. After the "morphing" step, the relation giving x as a function of t, x=f(t) is obtained. The speed is obtained by integrating this function.

The data output from the sensors $C^y{}_i$ are then interpreted.

Over time, these measurements form an image I(t,Y) distributed in time and on the line 4. The relation L(t−x) determined previously can be applied to each column i of I(t,Y) in other words to each time signal output from the sensors $C^y{}_i$.

Figure 4A:
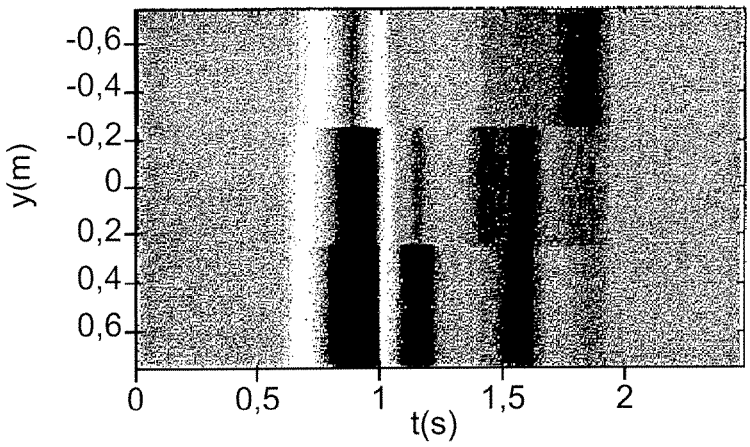
FIGS. 4A-4I show images for three components, before and after "morphing" type transformation.
Figure 4B:
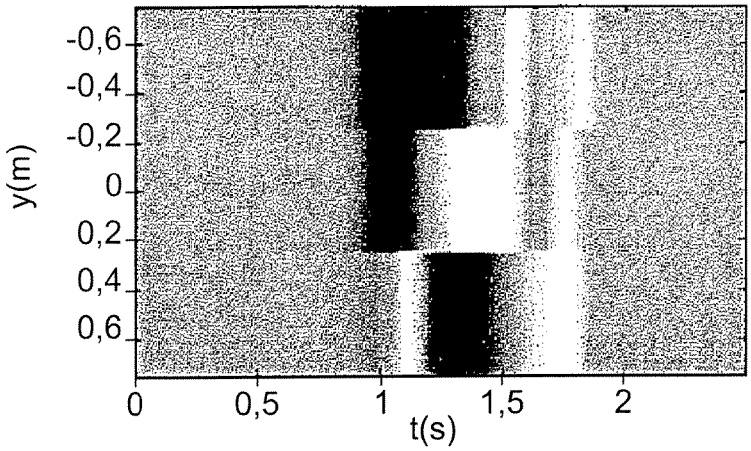
Figure 4C:
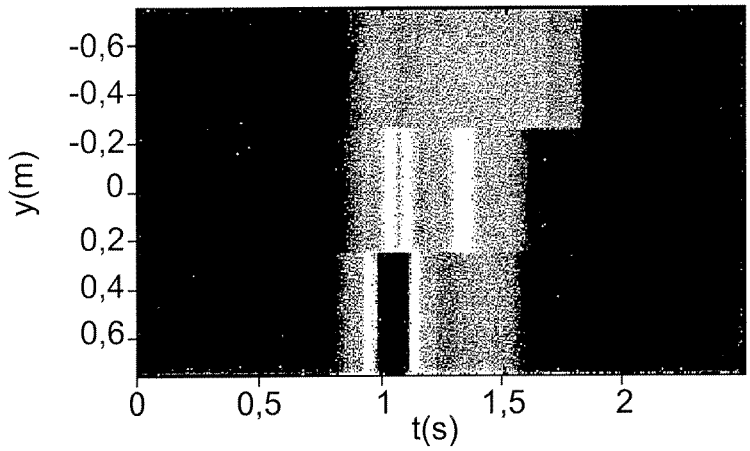
Figure 4D:
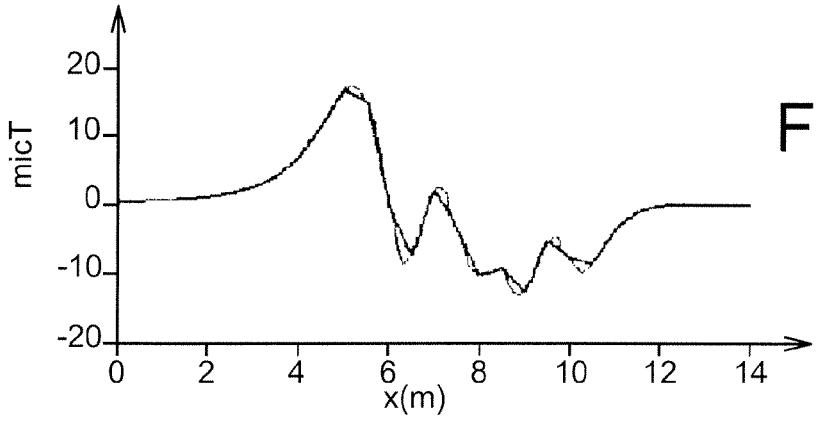
Figure 4E:
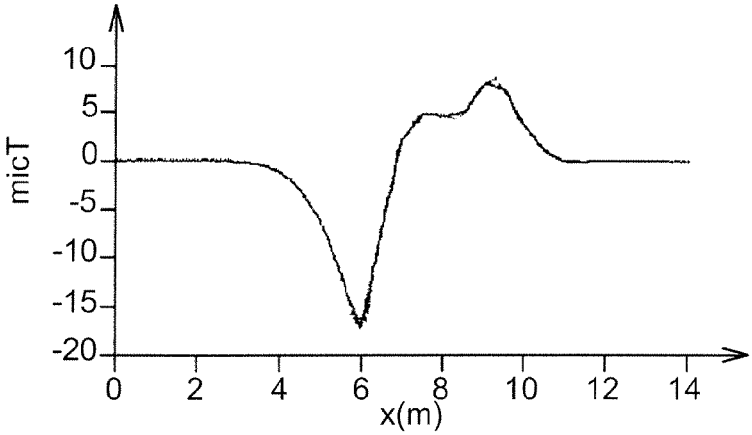
Figure 4F:
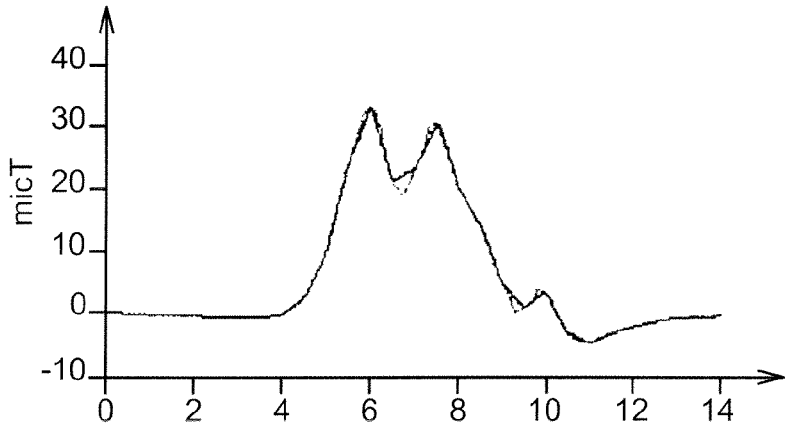
Figure 4G:
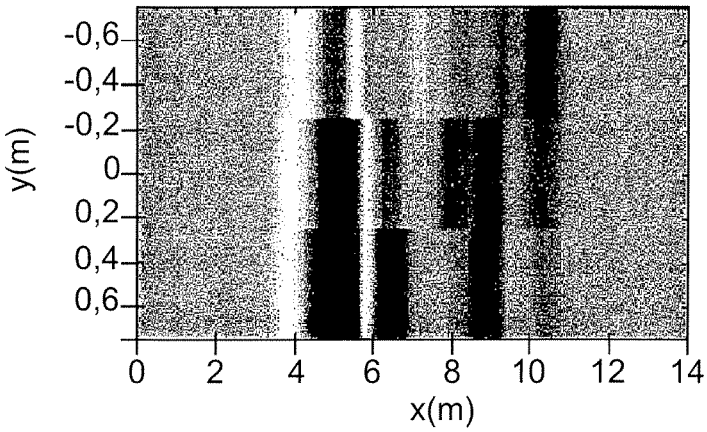
Figure 4H:
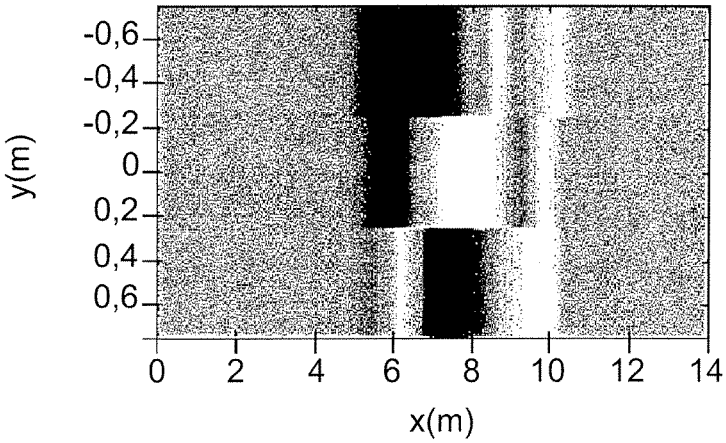
Figure 4I:
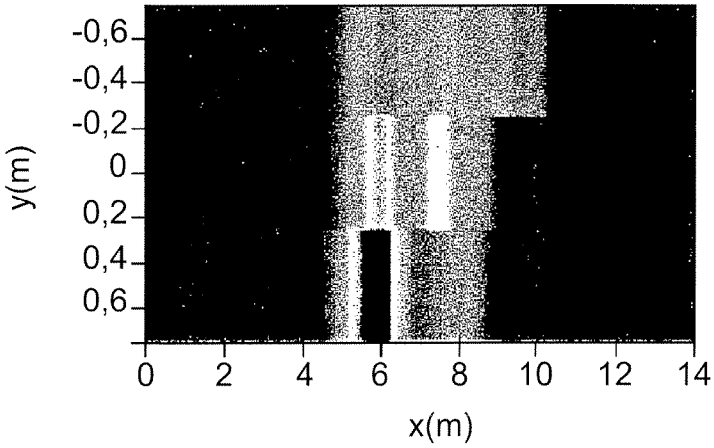

The result is thus a photo P(X,Y) of the vehicle signature, output from a single line of sensors. Thus, we have:

- in FIGS. 4A-4C: images I(t, Y) for the 3 components $B_x$, $B_y$, $B_z$ of the field;
- in FIGS. 4D-4F: central sections illustrating $S_o(t)$ after "morphing" (in thin lines) at $S_o(x)$ (in thick lines) (for each component $B_x$, $B_y$, $B_z$).
- in FIGS. 4G-4I: spatial images P(X,Y) output from the sensors $C^y{}_i$. (Once again, for each component $B_x$, $B_y$, $B_z$).

P(X,Y) represents the variation of the signature with time, replaced in space, without needing to determine the speed of the vehicle and without making any other assumption about its trajectory.

Therefore its acquisition is independent of the running speed and the vehicle trajectory.

According to the invention, a method for recognition of the magnetic signature of a moving object includes:

- the time measurement $S_o(t)$ by a magnetic sensor Co (the sensor $C^{xy}{}_0$) placed on the trajectory of the object,
- the measurement S(x) at an instant ta by the first magnetic sensors $C^x{}_i$ aligned with Co along the direction 2 of displacement along X,
- the point to point comparison of the time signal $S_o(t)$ and the space signal S(x),
- production of a relation t(x) between the times t and the sites or the positions x along the displacement direction,
- measurements $S_y(t)$ during time by second magnetic sensors $C^y{}_i$ aligned with Co along a direction Y (direction 4 or 4') different from the displacement direction 2,
- the transformation by the relation t(x) of measurements $S_y(t)$ into a space signal $S_y(x)$, magnetic spatial image of the object.

According to a second example embodiment, the basic device may be different, and the invention described above may be applied to different sensor configurations.

In the different configurations, an attempt is made to have a line 2 arranged along the running direction of the vehicle (X direction) and a common sensor with another line 8 of sensors, along which the "morphing" will be applied.

Figure 5A:
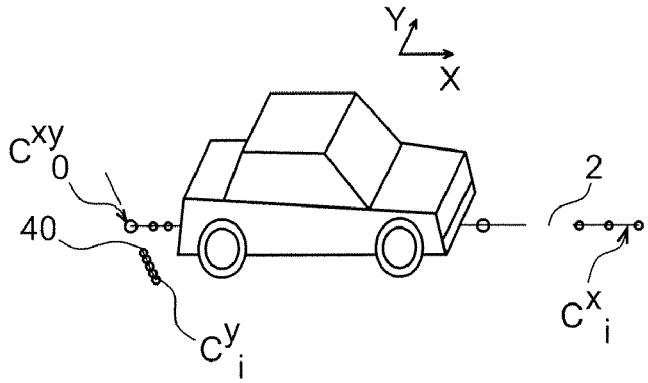
FIGS. 5A-5C show variant devices according to the invention.
Figure 5B:
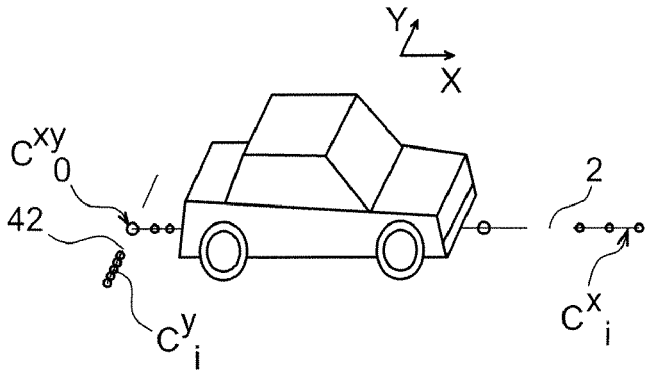
Figure 5C:
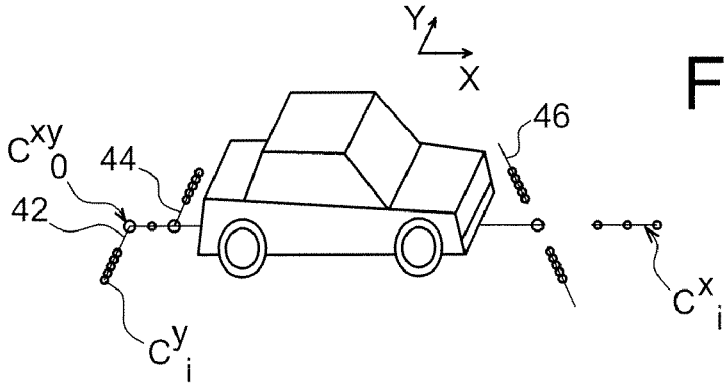

FIGS. 5A-5C show several example geometries according to this embodiment:

- FIG. 5A: system with sensor lines 2, 40 forming a "V";
- FIG. 5B: system with sensor lines 2, 42 forming a transverse half "T";
- FIG. 5C: system with several lines "Y" 42, 44, 46, each forming an angle with line 2; as for the case in FIG. 2, the "morphing" technique may be applied for each "Y" line 42, 44, 46 starting from the signature S(x) and each time signature derived from the common sensor between each "Y" line and the line of sensors forming S(x).

Figure 6:
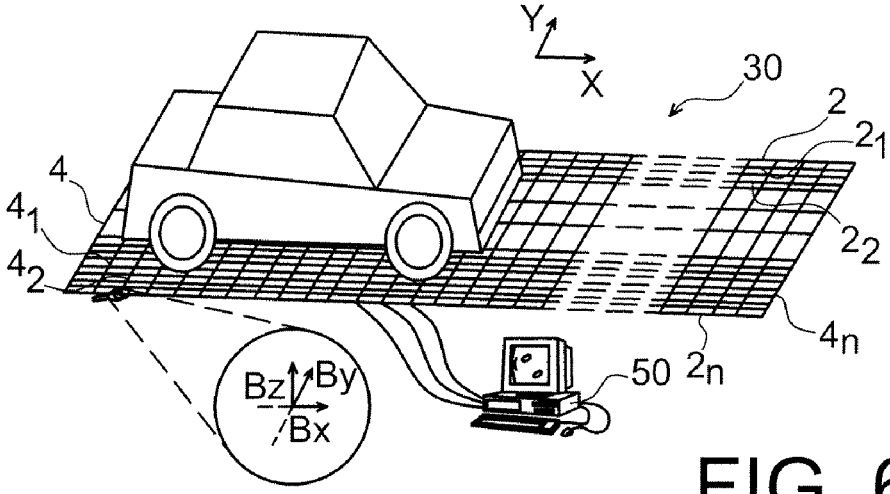
FIG. 6 shows an embodiment of a two-matrix device.

According to a third example embodiment (FIG. 6), a "hollow" matrix device forms n lines 2, $\mathbf{2}_1$, $\mathbf{2}_2$, $\mathbf{2}_3$ . . . , $\mathbf{2}_n$ arranged parallel to each other in the direction of displacement of vehicles, while m lines 4, $\mathbf{4}_1$, $\mathbf{4}_2$, $\mathbf{4}_3$ . . . , $\mathbf{4}_m$ are arranged along the Y direction parallel to each other. These m lines could be arranged other than perpendicular to the X axis. A sensor is placed at each intersection $\mathbf{2}_i$-$\mathbf{4}_j$.

The low cost and compactness of the installed sensors is used to collect a larger quantity of information: the device forms a 2D matrix or a carpet of sensors that are distributed under the road surface in a uniform or non-uniform manner.

This matrix is "hollow" at some locations: some sensors are missing or their density is not satisfactory for the precision required by the application. The "morphing" principle described above is then used to complete the missing data.

Two lines like those described above are chosen in the matrix to form a system of two lines at the intersection of which there is a sensor, and the morphing technique is applied in order to reconstruct missing data in the chosen zone. This operation can be repeated at several locations in the matrix.

At each instant, the measurements made by all the sensors form a spatial photo P(X,Y) of the vehicle signature, at some locations completed by the technique according to this invention.

As above, the acquisition of this photo is independent of the running speed and the trajectory of the vehicle.

Figure 7:
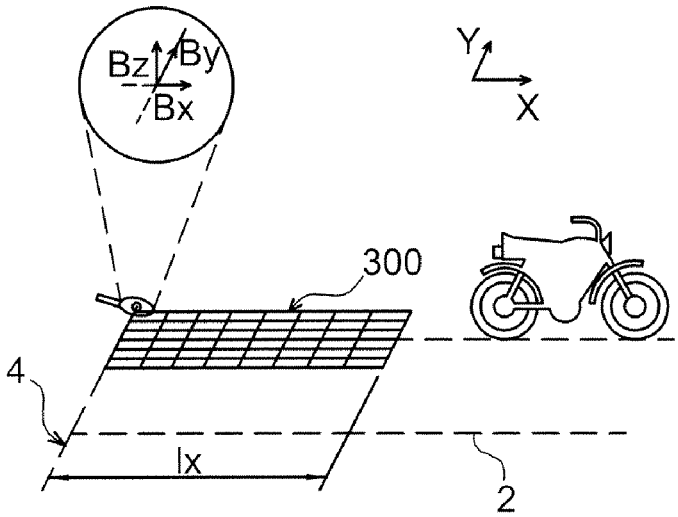
FIG. 7 shows an embodiment of a device with a plurality of "T".

A fourth example embodiment is a system with several basic devices (FIG. 7).

A small matrix 300 of sensors (denoted $M_{ij}$) is added to one of the basic devices (a "T" device in FIG. 7 described above with reference to FIGS. 5A-5C), placed on one of the sides (or both sides) of the "T" and occupying a length $l_x$.

Thus, an instantaneous image of a part of the vehicle signature can be obtained locally. In particular, if $l_x$ is equal to about 3 m, this matrix outputs the spatial development of one or several axle+wheel+tyre sets of a car or a lorry.

Furthermore, the matrix $M_{ij}$ can also be used to pickup signatures of small vehicles that could output a very weak signal on the sensor line 2. In particular, this can happen when a motorbike circulates on a tollbooth lane, hugging one side to make the transaction.

At each moment, the 2D photo output from the sensors in the matrix is capable of positioning the motorbike. Pre-processing determines the beginning and end of the useful signature.

Thus, it can be determined which line of sensors $M_i$ in the matrix coincides best with the running centreline of the motorbike.

This line can then be used with the line of sensors 4 to form another "T" device as explained above, with a dimension and position better adapted to this vehicle. The photo P(X,Y) of the spatial magnetic signature of the motorbike can then be recovered using a "morphing" method identical to that already presented above.

According to a fifth example embodiment, at least one sensor (1D, 2D or 3D field or field gradient sensor) is added to one of the devices described above along the vertical direction. This system is used to measure one or several field components (or gradient components) at a distance D, in at least one plane different from the plane of the devices described above. This information may be relevant to provide data about the height of vehicles.

A sixth embodiment is a device with an offset reference.

In this version, offset reference measurement means (1D, or 2D or 3D field or field gradient) are added to the previously described device. This means that these means are located sufficiently far from the measurement zone so that they are not sensitive to passage of the vehicle. This reference measurement can improve the measurement precision while subtracting geomagnetic and surrounding noise (industrial noise, tramway, electrical network, etc.).

When the device is being put into place, the sensors may for example be grouped in lines, that are seen as branches of the tree structure system that manages acquisition and storage of data.

A line comprises one or several nodes, each node including a monoaxial, biaxial or triaxial sensor and the associated electronics (filter, amplification, digitisation, multiplexing). Each node is connected to a high speed digital information exchange bus (for example USB).

A central system 50 (FIG. 6), for example a microcomputer specially programmed for this purpose, for example offset at the edge of the road surface, manages multiplexing, the acquisition speed and data storage. It also contains processing means or the processing system that interprets the measurements (pre-processing, morphing, extraction of parameters, classification).

Physically, the lines may be in the form of tubes buried under the road surface or strips in grooves formed on the surface of the road. This mechanism has the advantage that it is easy to install the classification device and that it requires less maintenance than current loops (that are "severely" affected by deformation of the road and incessant passage of vehicles). If a sensor is found to be defective, the line is taken out from the ground and the sensor is easily replaced. The central system 50 is not modified. Similarly, all or part of the lines can be used, depending on the needs of the specification system, without needing to take any action on the road.

We will now describe how data are interpreted.

All devices and methods described above can be used to capture the spatial 2D photo P(X,Y) of the vehicle. If several field or gradient components are recorded, the result is the corresponding number of images and components.

In the first step, parameters identifying the vehicle or its type are extracted from the photo. The photo contains the image of the distribution of dipoles characteristic of the signature.

For example, the spatial dimensions of the signature in the Y and X directions provide the vehicle width and length by thresholding, regardless of its speed, either in running, stopped or even in reverse.

Detection of intensity maxima provides the number of axles and their 2D position and their relative spacing.

Interpretation of the spectral content of the image gives the energy of the signature and its main Fourier coefficients.

If three photos are available output from triaxial field sensors, then the angle passed through by the total magnetic field vector of the vehicle $B=B_x+B_y+B_z$ can also be calculated. This is characteristic of the mild or disturbed nature of the signature, and may provide information about the height between the vehicle and the ground.

With a device according to the invention, the data obtained in the X direction may be strongly oversampled with no additional installation costs related to the sensors and the associated electronics, because they are derived from a time acquisition. It is then easy to approximate the derivative of P(X,Y) along X by calculating the difference $P(X_i,Y)-P(X_{i-1},Y)$. The result is a map of gradients, which can be interpreted to obtain better positioning of vehicle axles.

By prolonging a gradients map (measured or calculated), the vertical gradient can be obtained and then the vertical gradient on the field can be used to calculate an indication of the distance separating the magnetic sources that characterise the vehicle from the sensors, in other words a magnitude related to the vehicle height.

Secondly, these parameters are used in a classification algorithm. For example, one solution is based on the use of neural network type learning-reproduction.

A device 50 like a microcomputer is programmed to make use of one of the methods described above, starting from measurements output by the sensors.

The invention claimed is:

1. A system for measuring a magnetic signature of a vehicle, comprising:

at least a first set of sensors ($C^x_i$) that are stationary and arranged along at least a first direction;

at least a second set of sensors ($C^y_j$) that are stationary and arranged along at least one second direction that intersects the first direction;

a common sensor ($C^{xy}_0$) arranged at a location where the first set of sensors and the second set of sensors intersect, said common sensor belonging to the first and the second sets of sensors, wherein the first set of sensors and the second set of sensors are arranged so that the vehicle passes above at least part of the sensors of said first and second set of sensors; and calculation means for calculating a relation between a time signature $S_o(t)$ of the vehicle passing above the common sensor and a spatial profile $S_o(x)$ resulting from measurements made by the first set of sensors.

2. The system set forth in claim 1, wherein the at least one second direction is perpendicular to the first direction.

3. The system set forth in claim 1 or 2, further comprising:

a third set of sensors arranged along at least a third direction that intersects the first direction at a point at which another common sensor ($C^{xy}_1$) is placed, said another common sensor belonging to the first and third sets of sensors.

4. The system set forth in any one of claims 1 to 2, wherein the calculation means calculates a speed of the vehicle.

5. The system set forth in any one of claims 1 to 2, further comprising:

a plurality of the first sets of sensors and a plurality of the second sets of sensors arranged in a 2D matrix of sensors.

6. The system set forth in claim 5, wherein the matrix is hollow.

7. The system set forth in any one of claims 1 to 2, further comprising:

at least one second set of sensors, and at least one 2D matrix of sensors arranged on at least one side of the first set of sensors.

8. The system set forth in any one of claims 1 to 2, further comprising:

at least one 1D, or 2D or 3D field sensor or field gradient sensor arranged along a vertical direction.

9. The system set forth in any one of claims 1 to 2, further comprising:

at least one 1D, or 2D or 3D offset field sensor or field gradient sensor.

10. The system set forth in any one of claims 1 to 2, wherein the calculation means forms a spatial representation of the signature of the vehicle.

11. The system set forth in claim 10, wherein the calculation means extracts vehicle identification parameters from said spatial representation.

12. The system set forth in claim 11, wherein the calculation means extracts a length or width of the vehicle by thresholding said spatial representation.

13. The system set forth in claim 11, wherein the calculation means extracts a number of vehicle axles by detection of intensity maxima.

14. The system set forth in claim 11, wherein the calculation means calculates an energy of the signature or at least part of the signature's Fourier coefficients.

15. The system set forth in claim 11, further comprising:

a triaxial field sensor, wherein the calculation means uses an output of the triaxial field sensor to calculate an angle crossed by a magnetic field vector.

16. The system set forth in claim 11, wherein the calculation means calculates a derivative of the signature P(X,Y) along X.

17. The system set forth in claim 16, wherein the calculation means calculates a map of gradients.

18. The system set forth in claim 16, wherein the calculation means calculates a vertical gradient of a magnetic field and a ratio of this gradient to the magnetic field.

19. The system set forth in claim 11, further comprising:

a processor which uses said vehicle identification parameters in a classification algorithm.

20. A system for measuring a magnetic signature of a vehicle, comprising:

at least a first set of sensors ($C^x_i$) that are stationary and arranged along at least a first direction;

at least a second set of sensors ($C^y_j$) that are stationary and arranged along at least a second direction that intersects the first direction;

a common sensor ($C^{xy}_0$) arranged at a location where the first set of sensors and the second set of sensors intersect, said common sensor belonging to the first and the second sets of sensors, wherein the first set of sensors and the second set of sensors are arranged so that the vehicle passes above at least part of said first and second set of sensors; and a processor configured to calculate a relation between a time signature $S_o(t)$ of the vehicle passing above the common sensor and a spatial profile $S_o(x)$ resulting from measurements made by the first set of sensors.

* * * * *